US006295747B1

(12) United States Patent
Francis

(10) Patent No.: US 6,295,747 B1
(45) **Date of Patent: *Oct. 2, 2001**

(54) BAGGAGE TAG

(76) Inventor: Dennis F. Francis, 4512 Sterling La., Plano, TX (US) 75093

( * ) Notice: Subject to any disclaimer, the term of this patent is extended or adjusted under 35 U.S.C. 154(b) by 0 days.

This patent is subject to a terminal disclaimer.

(21) Appl. No.: 08/858,286

(22) Filed: May 19, 1997

(51) Int. Cl.[7] ..... G09F 3/20

(52) U.S. Cl. ..... 40/6; 40/638; 40/674; 40/675; 283/81

(58) Field of Search ..... 40/6, 630, 638, 40/674, 675; 283/81, 100, 101, 105, 108

(56) References Cited

U.S. PATENT DOCUMENTS

| | | | | |
|---|---|---|---|---|
| 3,228,129 | | 1/1966 | Gwinn et al. . | |
| 4,631,845 | | 12/1986 | Samuel et al. . | |
| 4,817,310 | * | 4/1989 | Breen et al. | 40/675 X |
| 4,882,861 | | 11/1989 | Holmes et al. . | |
| 4,951,971 | | 8/1990 | Whited | 283/80 |
| 5,145,211 | | 9/1992 | McKillip | 283/80 |
| 5,271,641 | | 12/1993 | Whited | 283/80 |
| 5,366,249 | | 11/1994 | Diemert | 283/80 |
| 5,378,515 | | 1/1995 | Hatton | 428/40 |
| 5,381,617 | | 1/1995 | Schwartztol et al. | 40/6 |

FOREIGN PATENT DOCUMENTS

| | | | | |
|---|---|---|---|---|
| 8802903 | * | 4/1988 | (WO) | 40/638 |

* cited by examiner

*Primary Examiner*—Brian K. Green
(74) *Attorney, Agent, or Firm*—Zarley, McKee, Thomte Voorhees & Sease; Dennis L. Thomte

(57) ABSTRACT

The present device provides a baggage tag attachable to the handle of a piece of baggage for displaying indicia of the identification and destination of a passenger owning the baggage. The tag has a first or base ply and a second tear resistant ply or liner. The underside faces of the base ply and tear resistant liner are arraigned for engagement with one another. An adhesive is disposed between the base ply and the liner for releasably sealing them together. It is preferred that a release coating be applied to the underside face of the liner. This allows the removal of the liner from the adhesive layer, allowing the adhesive to remain with the base ply. The base ply and liner each have cuts proximate one end thereof defining a claim stub. Upon removal of the claim stub, a length of the underside face of the base ply adjacent the base ply cut is exposed with the adhesive permitting the to tag ends to be secured around a bag handle.

9 Claims, 5 Drawing Sheets

BAGGAGE TAG

BACKGROUND OF THE INVENTION

1. Technical Field

The present device relates generally to baggage identification tags. More specifically, it relates to a novel baggage tag wherein the number of plys required to form the baggage tag is minimized while still providing a tag which resists tearing.

Large numbers of are people being transported today by bus, ship, and airplane. Generally, each of these passengers has one or more bags which travels with them to their destination. This necessitates a reliable means of identifying passengers' bags and destinations. In addition to being reliable, the process of tagging the bags must be done in as time efficient a manner as possible. There is nothing more frustrating for a passenger than to begin a trip by spending the first portion of the trip in a long line. Thus it is essential for the process to be as streamlined as possible, allowing the ticket agent to spend as little time as possible tagging the bag.

From a financial standpoint, it is extremely expensive for an airline to lose a bag. Some estimates place the dollar cost to an airline at $1,000 for a lost bag, when the cost of replacing the bag is combined with the cost of delivering a bag (if found) and the loss of goodwill to the airline. Finally, money spent on the bag tagging system is money lost by the airlines. Thus, another objective is to make the tag as inexpensively as possible and still accomplish its purpose.

2. Description of the Prior Art

Baggage identification tags have been used for some time. One example of such a tag is the three ply tag manufactured by Data Documents. In that configuration, the tag is comprised of three plys. The top ply is composed of paper and comprises the surface on which the identification information is printed. Below the paper ply is an adhesive layer, used to permanently join the paper ply to the second ply. This second ply is comprised of tear resistant VALERON®, used to impart a degree of tear resistance to the tag. Another layer of adhesive is used to connect the VALERON® ply to the paper liner which comprises the final ply. In another prior art arrangement, the paper is adhered to either a polyester or polypropylene ply. While these designs are certainly effective at accomplishing the task, additional expense is incurred as a result of the use of three plys and two adhesive layers.

Consequently, it is a primary objective of the present invention to provide a baggage tag utilizing two plys and one adhesive layer disposed therebetween.

An additional objective is to provide a baggage tag having a generally U-shaped cut or perforation in the tear resistant liner such that a pair of tear resistant fingers are positioned along the edge of the liner at the portion where the claim stub tongue is removed.

An alternative objective is to provide a baggage tag having a generally straight cut or perforation in the tear resistant liner such that a straight cut is positioned along the edge of the liner at the portion where the claim stub tongue is removed.

Another objective is to provide a baggage tag wherein a layer of release material such as silicone is placed on the underside of the tear resistant ply so that the tear resistant ply may be removed leaving the adhesive secured to the paper ply.

Another objective of the present invention is to provide a baggage tag wherein the base ply may comprise either paper or VALERON® material.

Another objective of the present invention is to provide a baggage tag wherein the liner comprises either paper or VALERON®.

Another objective is to provide a baggage tag wherein the printed identification information may be printed on either the paper or liner plys and wherein the paper or liner plys may serve as the claim stub.

Another objective is to provide a baggage tag wherein the base ply and liner further each comprise cuts or perforations proximate a first end, defining a claim stub between the cut and the first end, the spacing between the cut in the base ply and the first end being less than the spacing between the cuts in the liner and the first end, such that upon removal of the claim stub, a length of the adhesive on the underside face of the base ply is exposed, allowing the baggage tag to be looped around the handle of a piece of baggage, prior to securing the opposite ends of the baggage tag together.

SUMMARY OF THE INVENTION

The present invention provides a baggage tag attachable to the handle of a piece of baggage for displaying indicia of the identification and destination of a passenger owning the baggage. The tag has a first, base ply and a second, tear resistant ply or liner. In a preferred embodiment, the first or base ply would be constructed of a paper material, whereas the second ply or liner would be constructed of VALERON®. The construction design and function of the tag permits the tag to be looped around the baggage handle and opposite ends secured together but without adhering to the handle itself. Additionally, the tag is adapted for other types of baggage such as boxes. In that case, the protective liner would be completely stripped from the back of the tag so that the entire length of the tag may be adhered to the box.

Both the first and second plys are elongated strips of flexible material having first and second ends and exposed and underside faces. The underside faces of the base ply and tear resistant liner are arranged for engagement with one another. Either the base or tear resistant ply may have indicia of the identification and destination of a passenger printed thereon. An adhesive is disposed between the base ply and the liner for releasably sealing them together. It is preferred that a release coating be applied to the underside face of the liner. This allows the removal of a portion of the liner from the adhesive layer, exposing a portion of the adhesive on the base ply and allowing opposite ends of the tag to be adhered together. In a preferred embodiment of the invention, this release coating is silicone.

The base ply and liner each have respective cuts proximate one end thereof. The cuts define a claim stub between the cuts and the end of the ply. The cuts are made such that the spacing between the cut in the base ply and the end of the base ply is less than the spacing between the cut in the liner and the end of the liner. Consequently, upon removal of the claim stub, a length of adhesive on the underside face of the base ply adjacent the base ply cut is exposed. Thus, upon looping the baggage tag around the handle of a piece of baggage, the exposed length of adhesive on the underside of the base ply, is engageable with the exposed face of the liner adjacent the second end thereof, permitting the securement of the two tag ends and the securement of the baggage tag around the handle without adhering thereto.

DESCRIPTION OF THE PREFERRED EMBODIMENT

Figure 1:
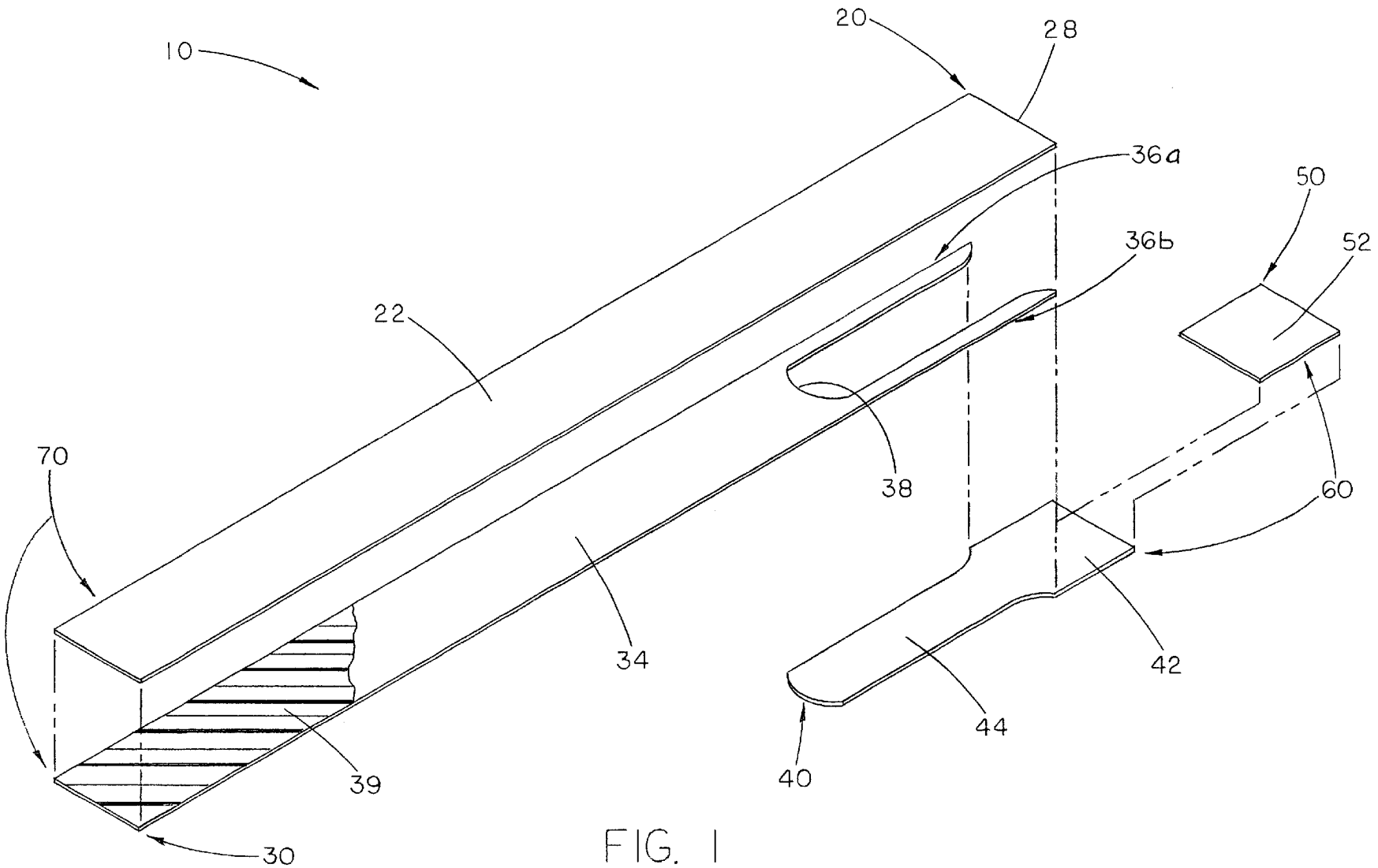
FIG. 1 is a top perspective view of the baggage tag of the present invention showing the four major components thereof.

A preferred embodiment of the present invention is illustrated in the exploded perspective view of FIG. 1. As seen in this view, there are two main components to the baggage tag apparatus 10 of the present invention, namely, the claim stub portion 60 and the tag handle portion 70. The tag 10 would have conventional dimensions of approximately 22 inches in length and approximately 2 inches in width. Obviously the dimensions may be altered to accommodate the particular printer or use of the tags. Each of these main components may be further separated into constituent components as seen in the figure.

The tag handle portion 70 comprises a first, base ply 20 and a second, liner ply 30. In the preferred embodiment, base ply 20 comprises a paper material whereas liner 30 comprises of a tear resistant material such as VALERON®. As is well understood in the art, VALERON® is the trademark of Van Leer Corporation for a tear resistant material, constructed in such a manner that its fibers are oriented perpendicular to one another to resist tearing. The material of the tear resistant liner is not limited to VALERON® since other acceptable materials may be commercially available now or in the future, but VALERON® is recited as one example of an acceptable material for the tear resistant liner. It is further contemplated that an alternative embodiment may provide a base ply of VALERON® material and a liner of paper material whereby the identification information would be printed on the VALERON® base ply which would be used as the bag tag and claim stub.

Constructing the base ply 20 of paper facilitates the printing of the passenger identification information thereon. As discussed above, this information may comprise the passenger's destination and some identifying information such as a claim number, etc.

The second ply or liner 30 serves two purposes. First, it provides a means for covering the majority of the adhesive 26 (FIG. 2) disposed between the two plys. A portion of this adhesive at the end of the tag 70 may be exposed to permit the securement of the two ends together around a handle as described below. Thus, the tag handle portion 70 may be looped around the baggage handle 82 and joined only at the ends of the tag 70 (FIG. 5), permitting the free movement of the tag 70 along the handle 82. Secondly, as mentioned, the second ply 30 is preferably constructed of a tear resistant material such as VALERON®. This diminishes the possibility of the tag 70 being ripped off and separated from the bag. Hopefully, this in turn increases the chance that the bag will make it to its proper destination.

Each of the two plys 20 and 30 comprise exposed faces 22 and 32 and underside faces 24 and 34. As described below, the underside faces 24 and 34 of plys 20 and 30 are adapted to be engaged together. Both the base and liner plys also comprise cuts or perforations 28 and 38 respectively, at one end thereof. These cuts define the claim stub portion 60. Cuts are preferred as they would facilitate separation of the stub portion 60.

Figure 2:
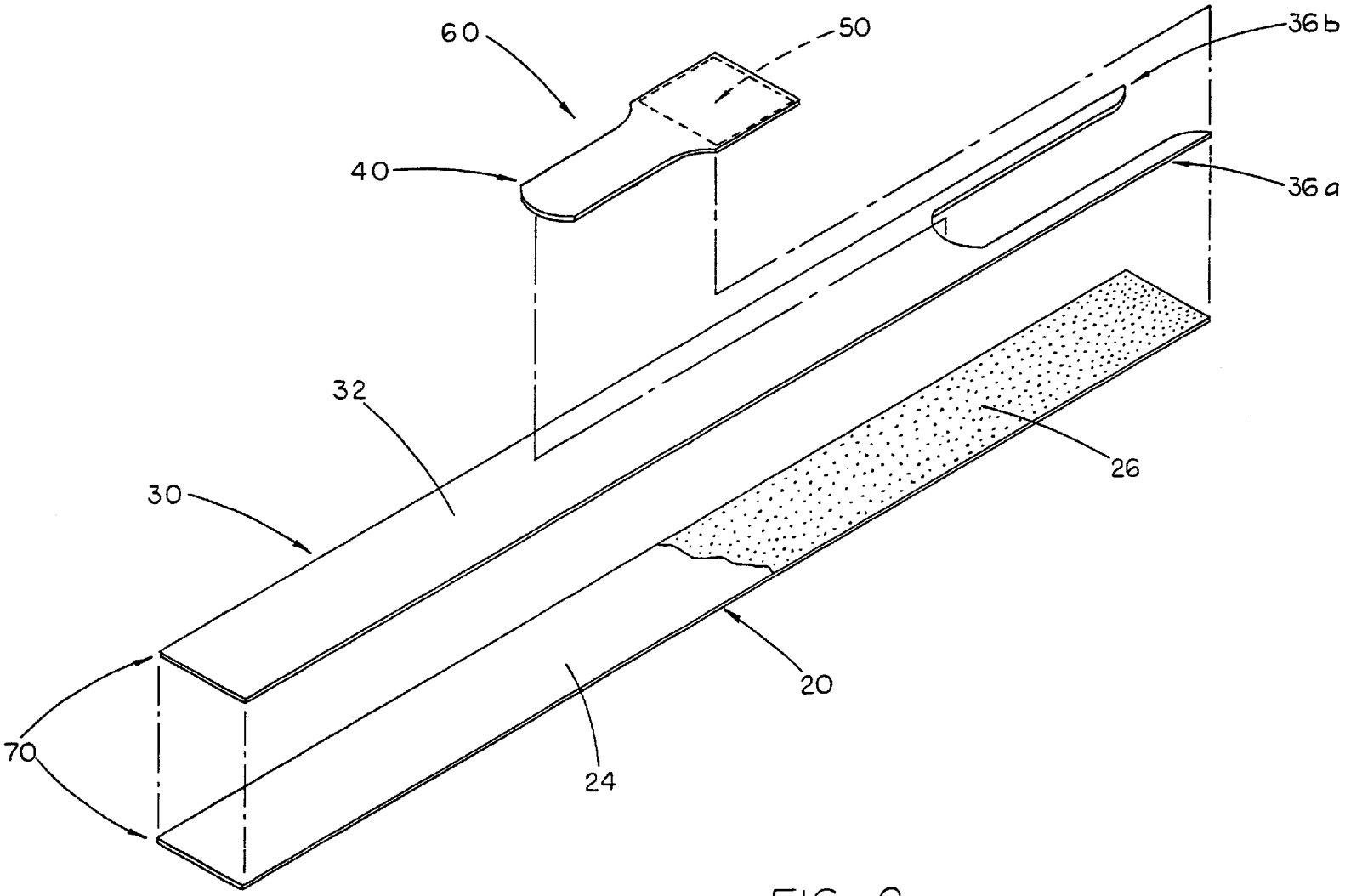
FIG. 2 is a bottom perspective view of the baggage tag of the present invention.

In the preferred embodiment shown in FIGS. 1 and 2, the cut 28 in ply 20 is straight. Thus, the base portion 50 of claim stub 60 is generally rectangular or square in shape. Conversely, the cut 38 in liner 30 is generally U-shaped. Thus, the liner portion 40 of claim stub 60 has an extended U-shaped tongue portion 44 corresponding to cut 38. Since the U extends inwardly toward the center of the ply 30 with the open end of the U opening toward the adjacent end, a portion of adhesive 26 is left exposed when the claim stub 60 is peeled away.

Figure 7:
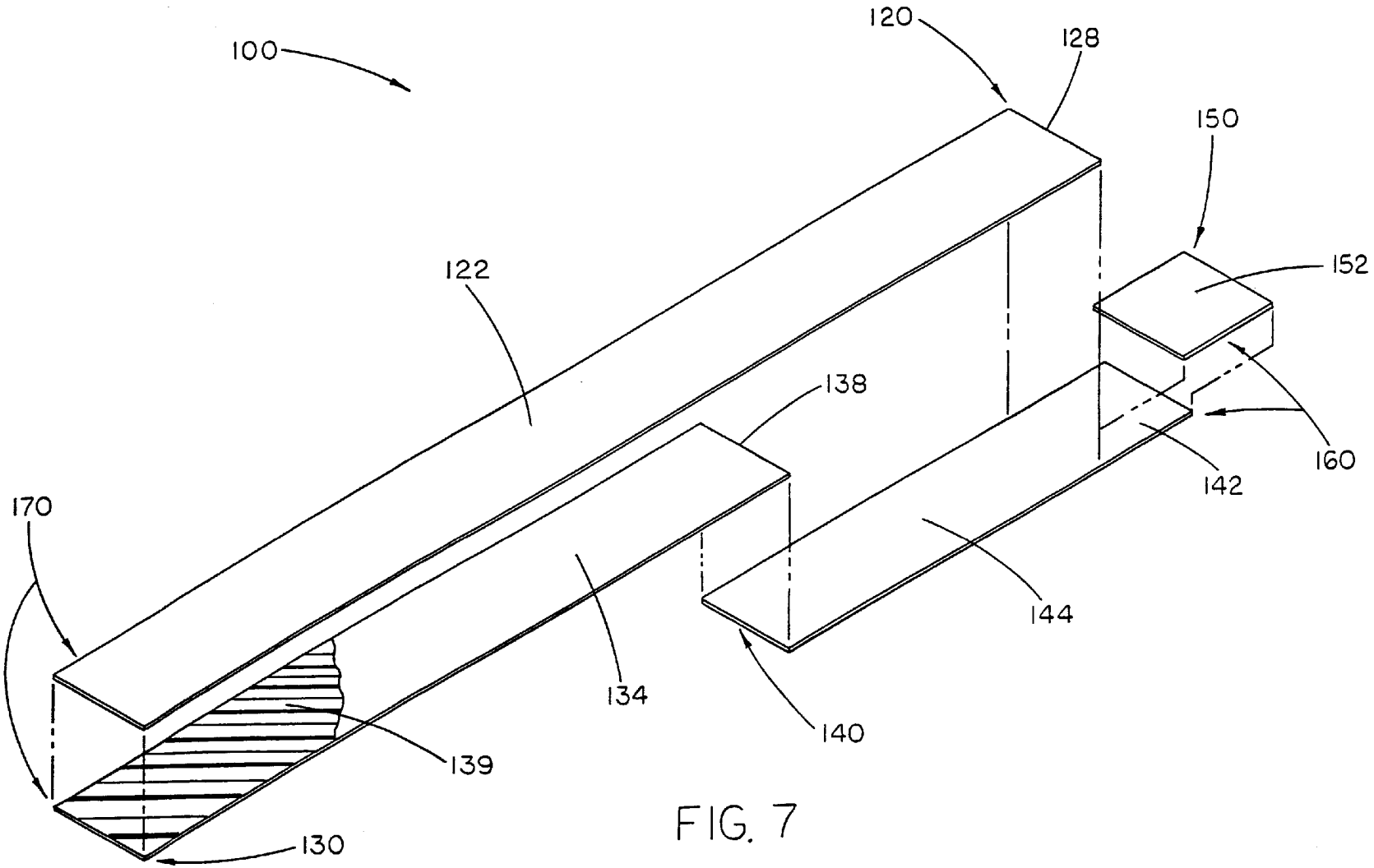
FIG. 7 is a top perspective view of an alternative embodiment of the baggage tag of the present invention showing the four major components thereof illustrating an alternative cut to define the claim stub.

While this is the preferred design for cut 38, other designs are also possible. For example, cut 38 could just as well be straight (FIG. 7). This would result in a tongue 44 on claim stub liner portion 40 generally rectangular in shape.

While the shape of the cut is not particularly important, the preferred U-shape cut has the following advantage. As seen in the figure, the U-shaped cut in liner 30 creates two fingers 36*a* and *b* extending along the outer edge of end portion of liner 30 when the claim stub 60 is removed. Of course fingers 36*a* and *b* are composed of the same tear resistant VALERON® material making up the remainder of the liner ply 30. Consequently, the fingers 36*a* and *b* provide resistance to tearing along the edge of the tag 70. If the cut were straight (FIG. 7) there would be no such fingers and the propensity of the tag to tear in this area would be greater. While the particular shape of cut 38 is not critical, it is important that at least a portion of the cut should extend inwardly of cut 28 in ply 20 so that a quantity of adhesive 26 is exposed to permit opposite ends of tag 70 to be secured together around handle 82.

As mentioned, the straight cut 28 of the first ply 20 results in a generally rectangular portion 50. The top surface 52 of portion 50 provides the surface upon which the identification information would be printed. This portion is adhesively fixed to the remaining portion 40 of the claim stub. The tongue portion 44 of the claim stub liner 40, provides a means for securing the claim stub to a ticket folder or the like. Obviously, the tongue 44 assumes the same shape as cut 38. Consequently, if cut 38 is U-shaped, tongue 44 will also be U-shaped. If the cut 38 is made more straight, then the tongue will assume a more rectangular shape. Either shape provides a means for securing the claim stub to the ticket.

As is well understood in the art, in the usual manner of using the tag 10 of the present invention, the ticket agent would insert the tag 10 into the printer at the ticket counter after the passenger information had been entered. The printer would then print on the tag portion 70 the destination information as well as some passenger identification information. Such information frequently takes the form of a bar code. In the preferred embodiment, this information would be printed on the exposed surface 22 of the first or base ply 20 of the tag 10. As mentioned above, it is preferable that this ply be constructed of paper which would facilitate the printing of the aforementioned information thereon. The printing process would also print the passenger identification information on the exposed surface 52 of claim stub portion 50. This portion 50 comprises the portion separated from base ply 20 by cut 28.

Figure 5:
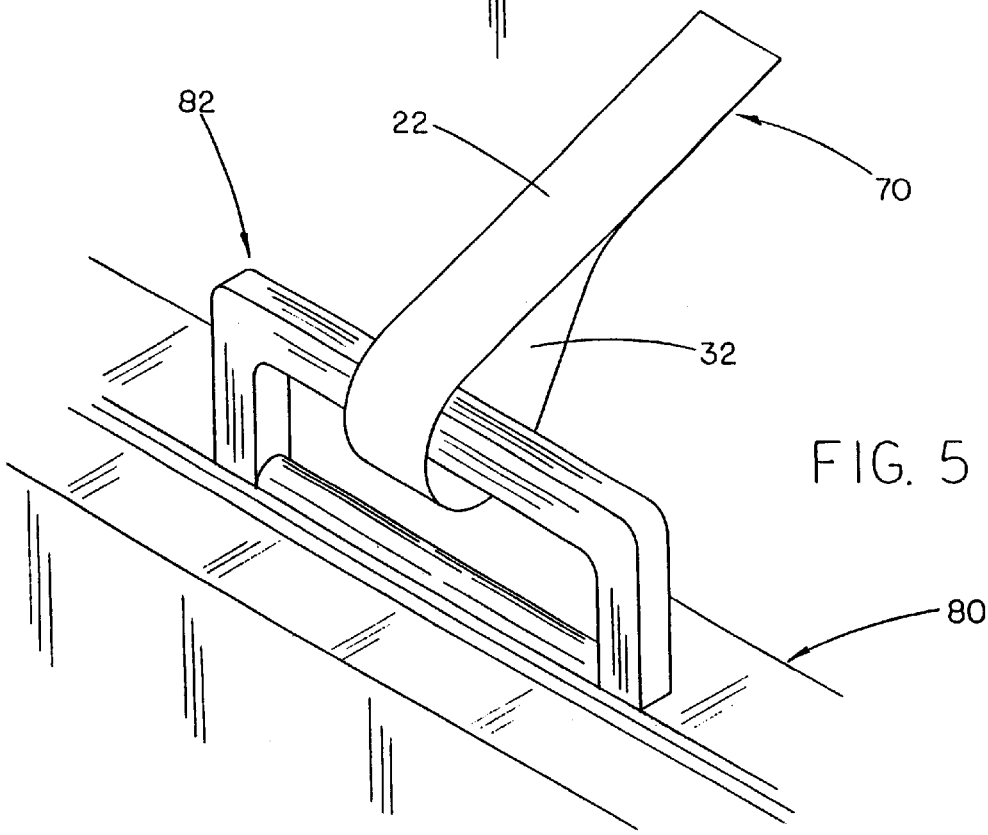
FIG. 5 is a perspective view of the baggage tag of the present invention in use, secured around the handle of a piece of baggage.

Finally, as seen in FIG. 1, there is a coating of release material 39 on the underside surface 34 of liner 30. This release coating layer facilitates the easy removal of the liner portion 40 of claim stub 60 from the adhesive layer 26 (FIG. 2). Removal of claim stub 60 exposes a portion of adhesive layer 26 on the underside of base ply 20 providing a means for adhering the opposite end of the tag 70 when looped around the handle 82 (FIGS. 5 and 6).

FIG. 2 is a bottom exploded perspective view of the tag 10 of the present invention. In this view, the adhesive layer 26 discussed above is now seen. As mentioned above, this adhesive layer 26 is disposed between the underside surface 24 of base ply 20 and the liner ply 30. The liner 30 is capable of being easily removed from this adhesive layer due to the coating of release material 39 which is applied to the underside 34 of liner ply 30. No such release coating is provided between the underside surface 24 of base ply 20 and the adhesive 26. Consequently, the adhesive layer 26 is permanently fixed to the underside surface 24 of this base ply 20.

Figure 6:
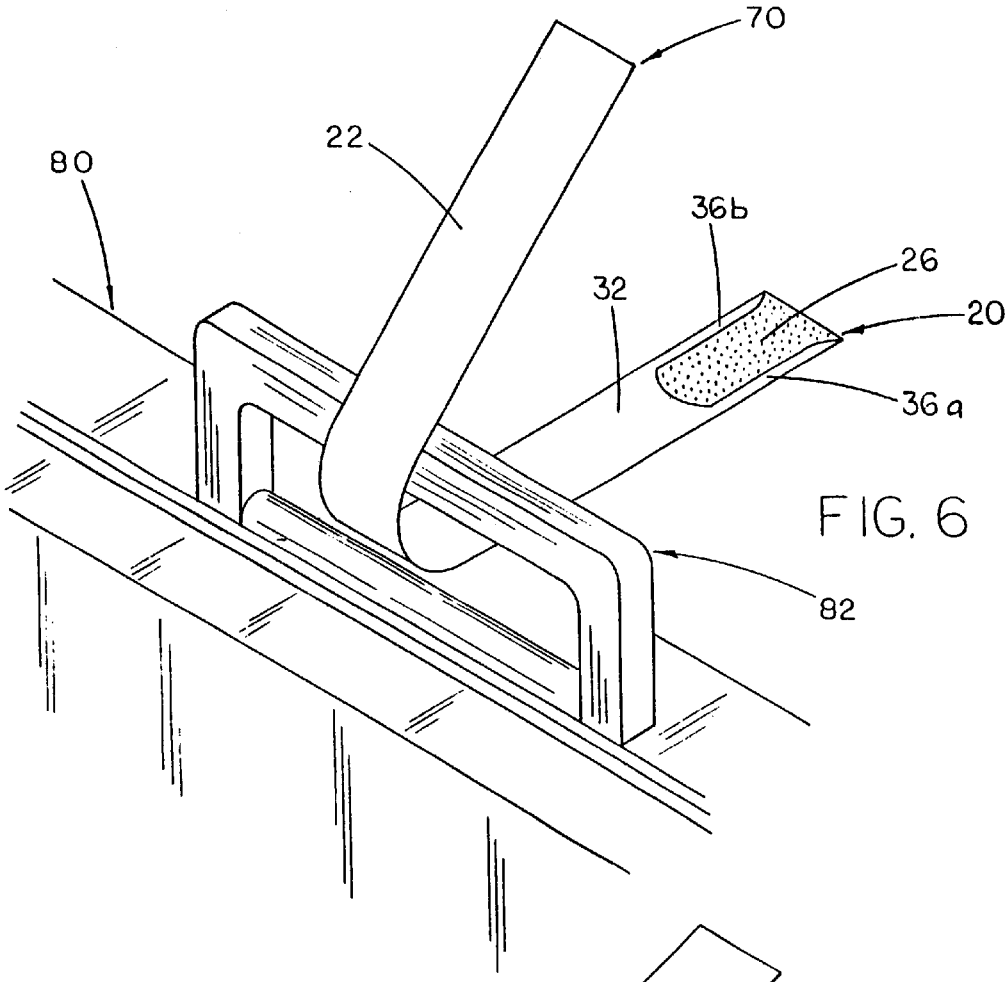
FIG. 6 is a perspective view of the baggage tag of the present invention partially folded showing how the tag would be assembled and illustrating the exposed adhesive use to secure opposite ends of the tag around a baggage handle.

As can be seen in the figure, and even more clearly in FIG. 6, the removal of claim stub 60 will produce a corresponding U-shaped area of exposed adhesive when the liner 30 is joined to the base ply 20. This exposed adhesive will provide a means for the two ends of the tag 70 to be joined as seen in FIGS. 5 and 6.

Figure 3:
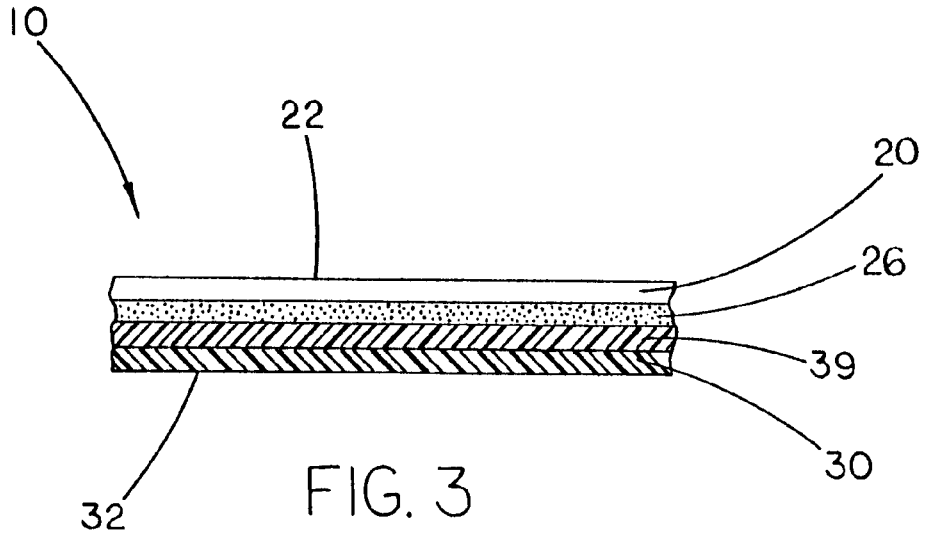
FIG. 3 is an enlarged cross-sectional side view of the baggage tag of the present invention showing the two plys and adhesive and release coating layers comprising the tag.
Figure 4:
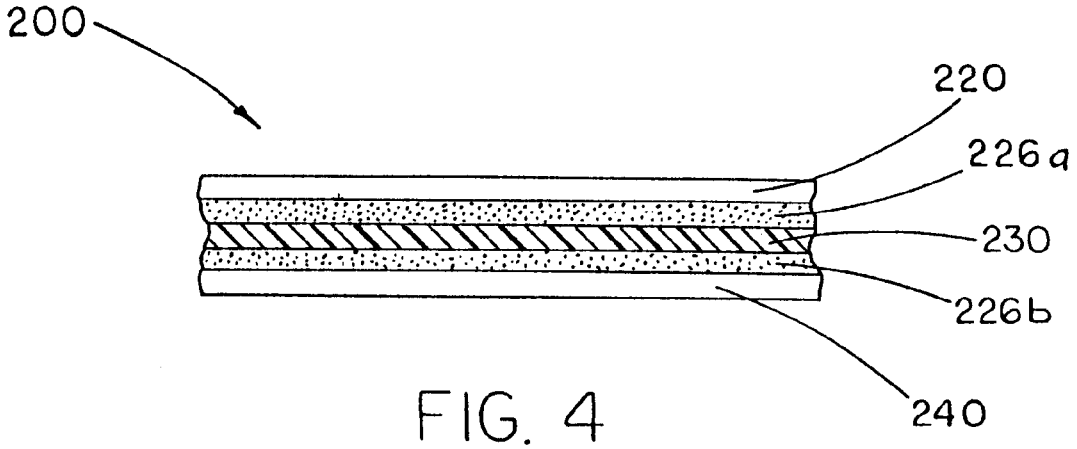
FIG. 4 PRIOR ART
FIG. 4 is an enlarged cross-sectional side view of a prior art baggage tag showing the three plys and two adhesive layers of material comprising the prior art tags.

FIGS. 3 and 4 represent cross-sectional side views of the present invention and the prior art respectively. As seen in FIG. 3, the tag comprises two plys 20 and 30, with adhesive 26 and release layers disposed therebetween. As described, the release coating 39, preferably silicone, is applied to the underside surface 34 of the liner ply 30. The adhesive layer 26 is then disposed between this silicone layer 39 and the underside surface 24 of base ply 20. As mentioned, this makes it easy for the claim stub liner ply 40, and consequently the claim stub, to be removed from the remainder of the tag 70.

FIG. 4 illustrates the prior art tag 200 comprising three plys and two adhesive layers. The top ply 220 is composed of paper and comprises the surface on which the identification information is printed. Below the paper ply is a first adhesive layer 226*a* which is used to join the paper ply 220 to the second ply 230. This second ply 230 is comprised of tear resistant VALERON®, used to impart a degree of tear resistance to the tag. Another layer of adhesive 226*b* is used to connect the VALERON® ply 230 to the paper liner 240 which comprises the final ply.

FIGS. 5 and 6 show the tag handle portion 70 in various stages of installation around the handle 82 of a bag 80. As seen in the figures, all of the surface in contact with the handle 82, is the exposed surface 32 of the liner ply 30. Since this is composed of VALERON® or other similar non-stick material, the tag 70 is able to move freely along the handle 82. FIG. 6 shows with particular clarity the exposed portion of adhesive 26. As mentioned above, it is this exposed portion of the adhesive which is used to secure the two ends of tag 70 together around handle 82. Also seen in the figure are the two fingers 36*a* and *b* which as mentioned provide a resistance to tearing of the tag 70 prior to its installation around the handle 82.

FIG. 7 is a top perspective view similar to that illustrated above in FIG. 1 illustrating an alternative embodiment tag 100. Referring to FIG. 7, features of this embodiment having a function similar to that in the preferred embodiment are prefaced with the number 1. For example, the tear resistant line 30 of the preferred embodiment of FIG. 1, is referred to as 130 in the alternative embodiment of FIG. 7. As mentioned, the main point of distinction between the embodiment illustrated in this FIG. and that illustrated in FIG. 1 above, is the nature of the cut in the liner 130. As mentioned, in this alternative embodiment, the cut 138 is straight instead of the U-shape of FIG. 1. As mentioned, the U-shape cut is preferred from the additional tear resistance provided by the fingers 36*a* and *b* resulting from such a cut. However, although the embodiment of FIG. 7 lacks these fingers, and thus the added tear resistance afforded thereby, it is easier to make a straight cut than the U-shaped cut. Additionally, with the embodiment of FIG. 7, the tear resistance is only diminished prior to installation of the tag around the handle. After the tag ends have been secured together, there is still a layer of the tear resistant VALERON® corresponding to the end which has been folded around into contact with the exposed adhesive 126.

In the embodiment shown in FIG. 7, the cut 128 in ply 120 is also straight. Thus, the base portion 150 of claim stub 160 is generally rectangular or square in shape. As mentioned, the cut 138 in liner 130 is also straight. Thus, the liner portion 140 of claim stub 160 has a generally rectangular shape as contrasted with the extended U-shaped tongue portion 44 corresponding to cut 38 in FIG. 1. Since the cut 138 is directed more inwardly than cut 128, liner portion 140 extends more inwardly than the claim stub base portion 150. Thus a portion of adhesive 126 (not shown) corresponding thereto, is left exposed on the underside of the ply 120 when the claim stub 160 is peeled away.

It is apparent that numerous other modifications and variations of the present invention are possible in view of the above teachings. For example, an important variation discussed above is the tag portion on which the identifying information is printed. As discussed, a preferred design utilizes the first or base ply for receiving this information. Alternatively, the information may also be printed on the liner portion. Additionally, the design of the cuts is not important. As discussed above, the cut on one ply may be straight while the other is U-shaped (FIG. 1). Alternatively, both may be cut straight (FIG. 7). The particular design is not important. Rather, only that an exposed adhesive portion (FIG. 6) be provided so that the tag may be looped around the handle and the ends of the tag secured together.

Therefore, it is to be understood that the above description is in no way intended to limit the scope of protection of the claims and it is representative of only one of several possible embodiments of the present invention.

There has thus been shown and described an invention which accomplishes at least all the stated objectives.

I claim:

1. A baggage tag attachable to a handle of a piece of baggage for displaying indicia of identification and destination of a passenger owning the baggage comprising:

a base ply and a tear resistant liner, each of said ply and liner being elongated strips of flexible material having first and second ends and exposed and underside faces;

the underside faces of said base ply and tear resistant liner arranged in engagement with one another;

said base ply adapted to have indicia of identification and destination of a passenger printed thereon;

adhesive means disposed between and releasably securing-said base ply and said liner together;

release means on said underside face of said liner for allowing the removal of said liner from said adhesive means; and said base ply and liner further each comprising respective cuts proximate said first end, said cut in said base ply defining a claim stub between said cut in said base ply and said first end, said cut in said liner being located more distant from said first end than the cut in the base ply such that upon removal of said claim stub, an exposed length of said adhesive is revealed on said underside face of said base ply adjacent said base ply cut, whereby, upon looping said baggage tag around the handle of the piece of baggage, the exposed length of said adhesive on the underside of said base ply is engageable with the exposed face of said liner adjacent the second end thereof to secure said baggage tag on the handle.

2. The baggage tag attachable to the handle of a piece of baggage of claim 1 wherein said release means disposed on said liner underside comprises silicone.

3. The baggage tag attachable to the handle of a piece of baggage of claim 1 wherein said base ply comprises a paper material.

4. A baggage tag attachable to a handle of a piece of baggage for displaying indicia of identification and destination of a passenger owning the baggage comprising:

first and second plys of material each of said plys being elongated strips of flexible material having first and second ends and exposed and underside faces;

the underside faces of said first and second plys arranged in engagement with one another;

one of said plys being adapted to have indicia of identification and destination of a passenger printed thereon, the other of said pays being formed of a tear resistant material;

adhesive means disposed between and releasably securing said second and first plys together;

release means on said underside face of said other ply for allowing the removal of said other ply from said adhesive means; and said first and second plys each further comprising respective cuts proximate said first ends, said cuts defining a claim stub between said cuts and said first ends, the cut in said first ply being Generally transverse and nearer said first end than the cut in said second ply, the cut in said second ply being generally U-shaped and opening toward said first end and forming a pair of fingers in said second ply, said u-shaped cut further defining a corresponding claim stub tongue positioned between said fingers such that upon removal of said claim stub, a generally U-shaped portion of said adhesive on said underside face of said first ply adjacent said first ply cut is exposed, whereby, upon looping said baggage tag around the handle of a piece of baggage, the exposed U-shaped portion of the adhesive on the underside of said first ply is engageable with the exposed face of said second ply adjacent the second end thereof to secure said baggage tag on the handle.

5. The baggage tag attachable to the handle of a piece of baggage of claim 5 wherein said release means disposed on said liner underside comprises silicone.

6. The baggage tag attachable to the handle of a piece of baggage of claim 4, wherein said base ply comprises a paper material.

7. A baggage tag attachable to a handle of a piece of baggage for displaying indicia of identification and destination of a passenger owning the baggage comprising:

a base ply and a liner, each of said ply and liner being elongated strips of flexible material having first and second ends and exposed and underside faces;

the underside faces of said base ply and liner arranged in engagement with one another, said base ply adapted to have indicia of the identification and destination of a passenger printed thereon;

adhesive means disposed between and releasably securing said base ply and said liner together;

release means on said underside face of said liner for allowing the removal of said liner from said adhesive means; and said base ply and liner further each comprising respective cuts proximate said first end, said cut in said base ply defining a claim stub between said cut in said base ply and said first end, said cut in said liner being located more distant from said first end than the cut in the base ply such that upon removal of said claim stub, a length of said adhesive is exposed on said underside face of said base ply adjacent said base ply cut, whereby, upon looping said baggage tag around the handle of a piece of baggage, the exposed length of the underside of said base ply is engageable with the exposed face of said liner adjacent the second end thereof to secure said baggage tag on the handle.

8. The baggage tag attachable to the handle of a piece of baggage of claim 7 wherein said base ply comprises a paper material.

9. The baggage tag attachable to the handle of a piece of baggage of claim 7 wherein said liner comprises a paper material.

* * * * *